US008911260B2

(12) United States Patent
Golko et al.

(10) Patent No.: US 8,911,260 B2
(45) Date of Patent: Dec. 16, 2014

(54) EXTERNAL CONTACT PLUG CONNECTOR

(75) Inventors: Albert J. Golko, Saratoga, CA (US); Arthur Stanley Brigham, Sunnyvale, CA (US); Roger Chen, Guishan Township (TW); Alice Yang, Zhoughe (TW)

(73) Assignee: Apple Inc., Cupertino, CA (US)

( * ) Notice: Subject to any disclaimer, the term of this patent is extended or adjusted under 35 U.S.C. 154(b) by 26 days.

(21) Appl. No.: 13/703,893

(22) PCT Filed: Jun. 21, 2011

(86) PCT No.: PCT/US2011/041290

§ 371 (c)(1), (2), (4) Date: Dec. 12, 2012

(87) PCT Pub. No.: WO2011/163260

PCT Pub. Date: Dec. 29, 2011

(65) Prior Publication Data

US 2013/0095701 A1 Apr. 18, 2013

Related U.S. Application Data

(60) Provisional application No. 61/357,023, filed on Jun. 21, 2010.

(51) Int. Cl.

| | |
|---|---|
| ***H01R 24/00*** | (2011.01) |
| ***H01R 13/6581*** | (2011.01) |
| ***H01R 24/62*** | (2011.01) |
| *H01R 13/22* | (2006.01) |
| *H01R 13/6599* | (2011.01) |

(52) U.S. Cl.

CPC ..... *H01R 23/025* (2013.01); *H01R 13/6581* (2013.01); *H01R 24/62* (2013.01); *H01R 13/22* (2013.01); *H01R 13/6599* (2013.01)

USPC ..... 439/660; 439/108

(58) Field of Classification Search

CPC ..... H01R 23/7068; H01R 23/7073; H01R 23/6873

USPC ..... 439/660, 108, 607.35

See application file for complete search history.

(56) References Cited

U.S. PATENT DOCUMENTS

| | | | |
|---|---|---|---|
| 2,792,557 | A | 5/1957 | Dowick |
| 2,892,990 | A | 6/1959 | Werndl |

(Continued)

FOREIGN PATENT DOCUMENTS

| | | |
|---|---|---|
| CN | 1397804 | 2/2003 |
| CN | 1830122 A | 9/2006 |

(Continued)

OTHER PUBLICATIONS

Office Action for Australian Application No. 2012245184, mailed Nov. 6, 2013, 3 pages.

(Continued)

*Primary Examiner* — Hae Moon Hyeon

(74) *Attorney, Agent, or Firm* — Kilpatrick Townsend & Stockton LLP

(57) ABSTRACT

The present disclosure relates generally to connectors such as audio and data connectors and in particular to low profile audio connectors that can be used in place of standard audio and data connectors currently used. The plug connector has a reduced plug length and thickness, an intuitive insertion orientation and a smooth, consistent feel when inserted and extracted from its corresponding receptacle connector. The plug connector may be characterized by a flat tip portion at its distal end, a base portion near its proximal end, a shell coupled at the base portion and a plurality of external contacts.

29 Claims, 8 Drawing Sheets

(56) References Cited

U.S. PATENT DOCUMENTS 3,760,335 A 9/1973 Roberts
3,793,614 A 2/1974 Tachick et al.
3,795,037 A 3/1974 Luttmer
4,361,375 A 11/1982 Bailey et al.
4,558,912 A 12/1985 Coller et al.
4,621,882 A 11/1986 Krumme
4,711,506 A 12/1987 Tanaka
5,040,994 A 8/1991 Nakamoto et al.
5,256,074 A 10/1993 Tan
5,295,843 A 3/1994 Davis et al.
5,380,225 A 1/1995 Inaoka
5,387,110 A 2/1995 Kantner et al.
5,442,243 A 8/1995 Bailey
5,554,042 A 9/1996 Denninger
5,594,284 A 1/1997 Hill et al.
5,785,557 A 7/1998 Davis
5,959,848 A 9/1999 Groves et al.
5,967,833 A 10/1999 Cachina
6,074,225 A 6/2000 Wu et al.
6,086,421 A * 7/2000 Wu et al. ..... 439/607.35
6,113,427 A * 9/2000 Wu ..... 439/607.47
6,179,627 B1 1/2001 Daly et al.
6,231,396 B1 5/2001 Huang
6,322,394 B1 * 11/2001 Katoh et al. ..... 439/607.11
6,364,699 B1 4/2002 Hwang et al.
6,410,857 B1 6/2002 Gonya
6,482,045 B2 11/2002 Arai
6,530,793 B2 3/2003 Eichhorn et al.
6,692,311 B1 2/2004 Kamei et al.
6,786,763 B2 9/2004 Wu
6,846,202 B1 1/2005 Schmidt et al.
6,869,320 B2 3/2005 Haas et al.
6,902,432 B2 6/2005 Morikawa et al.
6,948,965 B2 9/2005 Kumamoto et al.
6,948,983 B1 9/2005 Peng
6,948,984 B2 9/2005 Chen et al.
6,962,510 B1 11/2005 Chen et al.
6,964,582 B2 11/2005 Zhuang et al.
6,981,887 B1 1/2006 Mese et al.
7,021,971 B2 4/2006 Chou et al.
7,040,919 B2 5/2006 Yao
7,074,052 B1 7/2006 Ni et al.
7,094,086 B2 8/2006 Teicher
7,094,089 B2 8/2006 Andre et al.
7,160,125 B1 1/2007 Teicher
7,175,444 B2 2/2007 Lang et al.
7,198,522 B1 4/2007 Ho et al.
7,249,978 B1 7/2007 Ni
7,361,059 B2 4/2008 Harkabi et al.
7,363,947 B2 4/2008 Teicher
7,364,445 B1 4/2008 Ni et al.
7,387,539 B2 6/2008 Trenne
7,396,257 B2 7/2008 Takahashi
7,407,416 B1 8/2008 Rogers et al.
7,435,107 B2 10/2008 Masumoto et al.
7,440,286 B2 10/2008 Hiew et al.
7,442,091 B2 10/2008 Salolmon et al.
7,458,825 B2 12/2008 Atsmon et al.
7,500,861 B2 3/2009 Harkabi et al.
7,537,471 B2 5/2009 Teicher
7,549,896 B2 6/2009 Zhang et al.
7,559,805 B1 7/2009 Yi et al.
7,572,153 B2 8/2009 Trenne
7,591,657 B2 9/2009 Teicher
7,594,827 B2 9/2009 Takamoto et al.
7,695,318 B1 4/2010 Wang et al.
7,716,400 B2 5/2010 Raines
7,717,717 B1 5/2010 Lai
7,722,409 B2 5/2010 Takamoto et al.
7,727,027 B2 6/2010 Chiang et al.
7,740,498 B1 6/2010 Orsley
7,841,894 B2 11/2010 Gong et al.
7,872,873 B2 1/2011 Hiew et al.
7,892,014 B2 2/2011 Amidon et al.
7,918,685 B1 4/2011 Kruckenberg
8,007,309 B2 8/2011 Fan
8,062,073 B1 11/2011 Szczesny et al.
8,162,696 B2 4/2012 Elbaz et al.
8,246,388 B2 8/2012 Chen et al.
8,277,258 B1 10/2012 Huang et al.
8,282,417 B2 10/2012 Xiao
8,287,299 B2 10/2012 Ray et al.
8,461,465 B2 6/2013 Golko et al.
8,517,751 B1 * 8/2013 Golko et al. ..... 439/218
8,517,766 B2 8/2013 Golko et al.
8,545,269 B2 10/2013 Ore-Yang
8,561,879 B2 10/2013 Jol et al.
8,573,995 B2 11/2013 Golko et al.
8,647,156 B2 2/2014 Golko et al.
8,708,745 B2 4/2014 Golko et al.
8,777,666 B2 7/2014 Golko et al.
2001/0046809 A1 11/2001 Chiran et al.
2003/0016509 A1 1/2003 Tsukamoto
2003/0207606 A1 11/2003 Ho
2004/0229515 A1 11/2004 Kaneda et al.
2005/0042930 A1 2/2005 Harkabi et al.
2005/0079738 A1 4/2005 Ahn
2005/0085136 A1 4/2005 Zhang
2005/0124217 A1 6/2005 Zhuang et al.
2005/0124218 A1 6/2005 Chen et al.
2005/0124219 A1 6/2005 Chen et al.
2005/0202727 A1 9/2005 Andre et al.
2006/0019545 A1 1/2006 Moriyama et al.
2006/0024997 A1 2/2006 Teicher
2006/0040549 A1 2/2006 Yao
2006/0148300 A1 7/2006 Huang et al.
2006/0216991 A1 9/2006 Boutros
2006/0289201 A1 12/2006 Kim et al.
2007/0010115 A1 1/2007 Teicher
2007/0010116 A1 1/2007 Teicher
2007/0037452 A1 2/2007 Martin et al.
2007/0049100 A1 3/2007 Tsai
2007/0072442 A1 3/2007 DiFonzo
2007/0082701 A1 4/2007 Seil et al.
2007/0178771 A1 8/2007 Goetz et al.
2007/0202725 A1 8/2007 Teicher
2007/0243726 A1 10/2007 Trenne
2008/0032562 A1 2/2008 McHugh et al.
2008/0067248 A1 3/2008 Hiew et al.
2008/0090465 A1 4/2008 Matsumoto et al.
2008/0119076 A1 5/2008 Teicher
2008/0119291 A1 5/2008 Takamoto et al.
2008/0167828 A1 7/2008 Terlizzi et al.
2008/0274633 A1 11/2008 Teicher
2008/0309313 A1 12/2008 Farrar et al.
2009/0004923 A1 1/2009 Tang et al.
2009/0108848 A1 4/2009 Lundquist
2009/0117768 A1 5/2009 Liao
2009/0156027 A1 6/2009 Chen
2009/0180243 A1 7/2009 Lynch et al.
2010/0009575 A1 1/2010 Crooijmans et al.
2010/0062656 A1 3/2010 Lynch et al.
2010/0104126 A1 4/2010 Greene
2010/0171465 A1 7/2010 Seal et al.
2010/0221936 A1 9/2010 Zhao et al.
2010/0248544 A1 9/2010 Xu et al.
2010/0254602 A1 10/2010 Yoshino
2010/0254662 A1 10/2010 He et al.
2010/0267261 A1 10/2010 Lin et al.
2010/0267262 A1 10/2010 Lin et al.
2011/0136381 A1 6/2011 Cho
2011/0159719 A1 6/2011 Takahashi et al.
2011/0201213 A1 8/2011 Dabov et al.
2011/0250786 A1 10/2011 Reid
2011/0294354 A1 12/2011 Chen et al.
2011/0312200 A1 12/2011 Wang et al.
2012/0028495 A1 2/2012 Su et al.
2013/0075149 A1 3/2013 Golko et al.
2013/0078869 A1 3/2013 Golko et al.
2013/0089291 A1 * 4/2013 Jol et al. ..... 385/77
2013/0095702 A1 * 4/2013 Golko et al. ..... 439/676
2013/0115821 A1 5/2013 Golko et al.
2013/0122754 A1 5/2013 Golko et al.
2013/0149911 A1 6/2013 Golko et al.

(56) References Cited

U.S. PATENT DOCUMENTS

| | | | |
|---|---|---|---|
| 2013/0217253 | A1 | 8/2013 | Golko et al. |
| 2013/0244491 | A1 | 9/2013 | Sarwar et al. |
| 2013/0244492 | A1 | 9/2013 | Golko et al. |
| 2014/0068933 | A1 | 3/2014 | Brickner et al. |
| 2014/0069709 | A1 | 3/2014 | Schmidt et al. |
| 2014/0073183 | A1 | 3/2014 | Golko et al. |
| 2014/0073193 | A1 | 3/2014 | SooHoo et al. |
| 2014/0170907 | A1 | 6/2014 | Golko et al. |
| 2014/0206209 | A1 | 7/2014 | Kamei et al. |

FOREIGN PATENT DOCUMENTS

| | | | |
|---|---|---|---|
| CN | 201402871 | Y | 2/2010 |
| CN | 101783466 | A | 7/2010 |
| CN | 201533091 | U | 7/2010 |
| DE | 196 09 571 | A1 | 11/1995 |
| DE | 20 2004 021354 | U1 | 9/2007 |
| EP | 81372 | A2 | 6/1983 |
| EP | 1684391 | A2 | 7/2006 |
| EP | 1717910 | A2 | 11/2006 |
| EP | 2169774 | A1 | 3/2010 |
| EP | 2 373 131 | A1 | 10/2011 |
| FR | 2138961 | | 1/1973 |
| JP | 2 078171 | | 3/1990 |
| JP | 8321360 | A | 12/1996 |
| JP | 2003-217728 | | 7/2003 |
| JP | 2004-079491 | | 3/2004 |
| TW | M318831 | U | 9/2007 |
| TW | M350153 | U | 2/2009 |
| WO | 2004/097995 | A1 | 11/2004 |
| WO | 2005/013436 | A1 | 2/2005 |
| WO | 2005124932 | A2 | 12/2005 |
| WO | 2006/013553 | A2 | 2/2006 |
| WO | 2006/074348 | A1 | 12/2006 |
| WO | 2008/065659 | A2 | 6/2008 |
| WO | 2009/069969 | A2 | 6/2009 |
| WO | 2009/140992 | A1 | 11/2009 |
| WO | 2011043488 | A1 | 4/2011 |
| WO | 2011150403 | A1 | 12/2011 |
| WO | 2011163256 | A1 | 12/2011 |
| WO | 2013070767 | A1 | 5/2013 |
| WO | 2013082175 | A2 | 6/2013 |

OTHER PUBLICATIONS

Non-Final Office Action for U.S. Appl. No. 13/607,566, mailed Dec. 6, 2013, 20 pages.
Office Action for Australian Application No. 2011257975, mailed Dec. 16, 2013, 6 pages.
Extended European Search Report, EP App. No. 13165892.4, mailed Dec. 20, 2013, 6 pages.
Office Action for Korean Patent Application No. 10-2012-0125751, mailed Jan. 22, 2014, 6 pages.
Office Action for Mexican Patent Application No. MX/a/2012/013857, mailed Feb. 6, 2014, 3 pages.
Office Action, Canadian Patent Application No. 2,794,906; Mailed Mar. 4, 2014, 2 pages.
Notice of Allowance for U.S. Appl. No. 13/607,566, mailed Mar. 11, 2014, 8 pages.
Extended European Search Report, EP App. No. 14152776.2, mailed Mar. 11, 2014, 9 pages.
Office Action for United Kingdom Application No. 1400243.0, mailed Mar. 12, 2014, 4 pages.
First Office Action, Australian Patent Application No. 2012101657; Mailed Dec. 14, 2012, 4 pages.
International Preliminary Report on Patentability for International PCT Application No. PCT/US2011/038452, mailed Dec. 13, 2012, 19 pages.
International Preliminary Report on Patentability for International PCT Application No. PCT/US2011/041127, mailed Jan. 3, 2013, 8 pages.
International Preliminary Report on Patentability for International PCT Application No. PCT/US2011/041286, mailed Jan. 10, 2013, 12 pages.
International Search Report and Written Opinion for International PCT Application No. PCT/CN2012/081257, mailed on Jun. 20, 2013, 11 pages.
International Search Report and Written Opinion for International PCT Application No. PCT/US2012/063944, mailed Apr. 18, 2013, 23 pages.
Non-Final Office Action for U.S. Appl. No. 13/679,991, mailed Apr. 5, 2013, 19 pages.
Non-Final Office Action for U.S. Appl. No. 13/679,992, mailed Apr. 9, 2013, 18 pages.
Notice of Allowance for U.S. Appl. No. 13/679,992, mailed Jun. 11, 2013, 17 pages.
Notice of Allowance for U.S. Appl. No. 13/679,991, mailed Jul. 10, 2013, 22 pages.
Notice of Allowance for U.S. Appl. No. 13/679,996, mailed Apr. 12, 2013, 30 pages.
Notice of Allowance for U.S. Appl. No. 13/720,822, mailed Apr. 8, 2013, 30 pages.
Partial Search Report for International PCT Application No. PCT/US2012/063944 (mailed with Invitation to Pay Fees), mailed Feb. 20, 2013, 59 pages.
Partial Search Report for International PCT Application No. PCT/US2012/066881 (mailed with Invitation to Pay Fees), mailed Mar. 25, 2013, 8 pages.
Partial Search Report, EP App. No. 12191619.1, Mailed Feb. 20, 2013, 6 pages.
Search and Examination Report for United Kingdom Patent Application No. 1220045.7, mailed on Mar. 15, 2013, 7 pages.
Written Opinion for International PCT Application No. PCT/US2011/038452, mailed on Oct. 26, 2011, 17 pages.
Non-Final Office Action for U.S. Appl. No. 13/607,366, mailed Jul. 11, 2013, 23 pages.
Ex Parte Quayle Office Action for U.S. Appl. No. 13/761,001, mailed Jul. 17, 2013, 10 pages.
International Search Report and Written Opinion for International PCT Application No. PCT/US2013/038008, mailed Aug. 15, 2013, 12 pages.
Notice of Allowance for U.S. Appl. No. 13/761,001 , mailed Sep. 10, 2013, 9 pages.
International Search Report and Written Opinion for International PCT Application No. PCT/US2012/066881, mailed Sep. 9, 2013, 19 pages.
International Preliminary Report on Patentability for International PCT Application No. PCT/US2011/041290, mailed Jan. 10, 2013, 15 pages
International Search Report and Written Opinion for International PCT Application No. PCT/US2012/054318, mailed on Oct. 25, 2012, 47 pages.
Extended European Search Report, EP App. No. 12191619.1, Mailed Jul. 10, 2013, 13 pages.
International Search Report and Written Opinion for International PCT Application No. PCT/US2013/037233, mailed on Oct. 1, 2013, 14 pages.
Notice of Allowance for U.S. Appl. No. 13/607,366, mailed Oct. 31, 2013, 14 pages.
Office Action and Search Report for Taiwanese Application No. 100118944, mailed Sep. 16, 2013, 24 pages.
Flipper Press Release (Jun. 25, 2012) and Data Sheet: http://www.flipperusb.com/images/flipperUSB-brochure.pdf, http://www.flipperusb.com/images/flipperUSB-brochure.pdf.
International Search Report for International PCT Application No. PCT/US2011/038452, mailed on Oct. 26, 2011, 7 pages.
International Search Report and Written Opinion for International PCT Application No. PCT/US2011/041286, mailed on Oct. 20, 2011, 18 pages.
International Search Report and Written Opinion for International PCT Application No. PCT/US2011/041127, mailed on Dec. 29, 2011, 17 pages.

(56) References Cited

OTHER PUBLICATIONS

International Search Report and Written Opinion for International PCT Application No. PCT/US2011/041290, mailed on Nov. 21, 2011, 21 pages.
Office Action for United Kingdom Patent Application No. 1220045.7, mailed on Mar. 7, 2014, 3 pages.
Office Action for Russian Application No. 2012157740, mailed Mar. 21, 2014, 5 pages.
Partial Search Report for International PCT Application No. PCT/US2014/012535 (mailed with Invitation to Pay Fees), mailed Apr. 4, 2014, 7 pages.
Non-Final Office Action for U.S. Appl. No. 13/700,441, mailed Apr. 10, 2014, 36 pages.
Office Action for Australian Application No. 2012245184, mailed Apr. 28, 2014, 3 pages.
Office Action for Korean Patent Application No. 10-2012-7034333, mailed Apr. 29, 2014, 6 pages.
Office Action for Taiwanese Patent Application No. 100121725, mailed May 1, 2014, 8 pages.
Office Action, Canadian Patent Application No. 2,800,738, mailed May 8, 2014, 2 pages.
Non-Final Office Action for U.S. Appl. No. 13/704,236, mailed May 19, 2014, 10 pages.
European Search Report, EP App. No. 13195854.8, mailed Mar. 12, 2014, 7 pages.
International Preliminary Report on Patentability for International PCT Application No. PCT/US2012/066881, mailed Jun. 12, 2014, 14 pages.
Office Action for Korean Patent Application No. 10-2013-7001302, mailed Jun. 13, 2014, 9 pages.
Non-Final Office Action for U.S. Appl. No. 13/704,234, mailed Jul. 11, 2014, 6 pages.
Office Action for Chinese Patent Application No. 201310711187.1, mailed Jul. 14, 2014, 5 pages.
Office Action for Mexican Patent Application No. MX/a/2012/013857, mailed Jul. 23, 2014, 4 pages.
Final Office Action for U.S. Appl. No. 13/700,441, mailed Aug. 21, 2014, 9 pages.
Office Action for Malaysian Patent Application No. PI2012005119, mailed on May 15, 2014, 4 pages.
International Preliminary Report on Patentability for International PCT Application No. PCT/US2012/063944, mailed May 22, 2014, 15 pages.
International Preliminary Report on Patentability for International PCT Application No. PCT/US2012/054318, mailed Jun. 12, 2014, 8 pages.
International Search Report and Written Opinion for International PCT Application No. PCT/US2012/066881, mailed Jun. 12, 2014, 14 pages.
Office Action for Australian Application No. 2013204685, mailed Jul. 17, 2014, 2 pages.
Office Action for Korean Patent Application No. 10-2014-0048365, mailed Aug. 11, 2014, 4 pages.
Office Action for Australian Patent Application No. 2013205161, mailed Aug. 18, 2014, 4 pages.
Non-Final Office Action for U.S. Appl. No. 13/610,631, mailed Sep. 16, 2014, 28 pages.
Notice of Allowance for U.S. Appl. No. 13/704,236, mailed Sep. 17, 2014, 9 pages.
Office Action for Chinese Patent Application No. 201180030576.7, mailed Sep. 2, 2014, with English translation, 23 pages.

* cited by examiner

EXTERNAL CONTACT PLUG CONNECTOR

CROSS-REFERENCES TO RELATED APPLICATIONS

This application claims the benefit of U.S. Prov. Pat. App. No. 61/357,023, filed Jun. 21, 2010, and titled "EXTERNAL CONTACT AUDIO CONNECTOR," which is incorporated herein by reference for all purposes.

FIELD OF INVENTION

The present invention relates generally to connectors such as audio connectors and data connectors and in particular to low profile audio connectors and data connectors that can be used in place of standard audio connectors currently used.

BACKGROUND OF THE INVENTION

The present invention relates generally to input/output electrical connectors such as audio connectors and data connectors.

Standard audio connectors or plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions that extend along the length of the connectors in distinct portions of the plug such as the tip, sleeve and one or more middle portions between the tip and sleeve resulting in the connectors often being referred to as tip, ring and sleeve (TRS) connectors.

FIGS. 1A and 1B illustrate examples of audio plugs 10 and 20 having three and four conductive portions, respectfully. As shown in FIG. 1A, plug 10 includes a conductive tip 12, a conductive sleeve 16 and a conductive ring 14 electrically isolated from the tip 12 and the sleeve 16 by insulating rings 17 and 18. The three conductive portions 12, 14, 16 are for left and right audio channels and a ground connection. Plug 20, shown in FIG. 1B, includes four conductive portions: a conductive tip 22, a conductive sleeve 26 and two conductive rings 24, 25 and is thus sometimes referred to as a tip, ring, ring, sleeve (TRRS) connector. The four conductive portions are electrically isolated by insulating rings 27, 28 and 29 and are typically used for left and right audio, microphone and ground signals. As evident from FIGS. 1A and 1B, each of audio plugs 10 and 20 are orientation agnostic. That is, the conductive portions completely encircle the connector forming 360 degree contacts such that there is no distinct top, bottom or side to the plug portion of the connectors.

When plugs 10 and 20 are 3.5 mm miniature connectors, the outer diameter of conductive sleeve 16, 26 and conductive rings 14, 24, 25 is 3.5 mm and the insertion length of the connector is 14 mm. For 2.5 mm subminiature connectors, the outer diameter of the conductive sleeve is 2.5 mm and the insertion length of the connector is 11 mm long. Such TRS and TRRS connectors are used in many commercially available MPEG-1 or MPEG-2 Audio Layer III (MP3) players and smart phones as well as other electronic devices. Electronic devices such as MP3 players and smart phones are continuously being designed to be thinner and smaller and/or to include video displays with screens that are pushed out as close to the outer edge of the devices as possible. The diameter and length of current 3.5 mm and even 2.5 mm audio connectors are limiting factors in making such devices smaller and thinner and in allowing the displays to be larger for a given form factor.

Many standard data connectors are also only available in sizes that are limiting factors in making portable electronic devices smaller. Additionally, and in contrast to the TRS connectors discussed above, many standard data connectors require that they be mated with a corresponding connector in a single, specific orientation. Such connectors can be referred to as polarized connectors. As an example of a polarized connector, FIGS. 2A and 2B depict a micro-Universal Serial Bus (micro-USB) connector 30, the smallest of the currently available Universal Serial Bus (USB) connectors. Connector 30 includes a body 32 and a metallic shell 34 that extends from body 32 and can be inserted into a corresponding receptacle connector. As shown in FIGS. 2A, 2B, shell 34 has angled corners 35 formed at one of its bottom plates. Similarly, the receptacle connector (not shown) with which connector 30 mates has an insertion opening with matching angled features that prevents shell 34 from being inserted into the receptacle connector the wrong way. That is, it can only be inserted one way—in an orientation where the angled portions of shell 34 align with the matching angled portions in the receptacle connector. It is sometimes difficult for the user to determine when a polarized connector, such as connector 30 is oriented in the correct insertion position.

Connector 30 also includes an interior cavity 38 within shell 34 along with contacts 36 formed within the cavity. Cavity 38 is prone to collecting and trapping debris within the cavity which may sometimes interfere with the signal connections to contacts 36. Also, and in addition to the orientation issue, even when connector 30 is properly aligned, the insertion and extraction of the connector is not precise, and may have an inconsistent feel. Further, even when the connector is fully inserted, it may have an undesirable degree of wobble that may result in either a faulty connection or breakage.

Many other commonly used data connectors, including standard USB connectors, mini USB connectors, FireWire connectors, as well as many of the proprietary connectors used with common portable media electronics, suffer from some or all of these deficiencies or from similar deficiencies.

BRIEF SUMMARY OF THE INVENTION

Various embodiments of the invention pertain to plug connectors and receptacle connectors that improve upon some or all of the above described deficiencies. Other embodiments of the invention pertain to methods of manufacturing such plug and/or receptacle connectors as well as electronic devices that include such connectors. Embodiments of the invention are not limited to any particular type of connector and may be used for numerous applications. Some embodiments, however, are particularly well suited for use as audio connectors and some embodiments are particularly well suited for data connectors.

In view of the shortcomings in currently available audio and data connectors as described above, some embodiments of the present invention relate to improved audio and/or data plug connectors that have a reduced plug length and thickness, an intuitive insertion orientation and a smooth, consistent feel when inserted and extracted from its corresponding receptacle connector. Additionally, some embodiments of plug connectors according to the present invention have external contacts instead of internal contacts and do not include a cavity that is prone to collecting and trapping debris. The contacts can be symmetrically spaced on one or both of the first and second major opposing sides. The plug connector can have a 180 degree symmetrical shape so that it can be inserted and operatively coupled to a corresponding receptacle connector in either of two insertion orientations. In some embodiments, the connector tab includes at least one retention feature, e.g., notches, adapted to engage with a retention feature, e.g., protrusions, on a corresponding receptacle connector. In some further embodiments the plug connector includes one or more ground contacts formed on the side surfaces or the retention features of the plug connector.

In one embodiment, a plug connector according to the present invention includes a metal plate and a dielectric spacer. The metal plate has a substantially flat tip portion at its distal end with first and second opposing major sides and a central opening formed through the metal plate. The dielectric spacer has a substantially flat tip portion formed within the opening in the metal plate and a base portion that is thicker than the tip portion formed at a proximal end of the metal plate. The spacer further includes a first and second opposing outer surfaces that extend from the tip portion to the base portion and a plurality of slots formed at each of the first and second outer surfaces. A plurality of external contacts positioned within the plurality of slots in the dielectric spacer.

A plug connector according to another embodiment of the invention comprises a dielectric core and a plurality of external contacts. The dielectric core has first and second opposing major surfaces and a plurality of grooves formed within each of the first and second major surfaces where the grooves are symmetrically formed on left and right halves of the dielectric core. The plurality of contacts includes a set of contacts positioned within the plurality of grooves in the dielectric core. The plug connector has a substantially flat tab portion at its distal end on which at least a portion of the plurality of external contacts are carried.

A plug connector according to yet another embodiment of the invention comprises a plug body having a substantially flat tab portion and first and second opposing major surfaces and a plurality of contacts positioned on the first and second opposing surfaces in a 180 degree symmetric relationship so the plug connector can be inserted into a corresponding receptacle connector in either of two positions. In some embodiments, the plug body comprises a ceramic core and includes a plurality of grooves formed on the first and second opposing surfaces in corresponding to the plurality of contacts. In other embodiments, the plug body comprises a metal core and a recessed area formed the first and second opposing surfaces, and the plurality of external contacts are formed on a flex circuit that is adhered to the metal core in the recessed area.

To better understand the nature and advantages of the present invention, reference should be made to the following description and the accompanying figures. It is to be understood, however, that each of the figures is provided for the purpose of illustration only and is not intended as a definition of the limits of the scope of the present invention.

BRIEF DESCRIPTION OF THE DRAWINGS

FIG. 2A shows a perspective view of a previously known micro-USB plug connector while

DETAILED DESCRIPTION OF THE INVENTION

Embodiments of the present invention are suitable for a multiplicity of electronic devices, including any device that receives or transmits audio, video or data signals among others. In some instances, embodiments of the invention are particularly well suited for portable electronic media devices because of their potentially small form factor. As used herein, an electronic media device includes any device with at least one electronic component that may be used to present human-perceivable media. Such devices may include, for example, portable music players (e.g., MP3 devices and Apple's iPod devices), portable video players (e.g., portable digital video disc (DVD) players), cellular telephones (e.g., smart telephones such as Apple's iPhone devices), video cameras, digital still cameras, projection systems (e.g., holographic projection systems), gaming systems, personal digital assistants (PDAs), desktop computers, as well as tablet (e.g., Apple's iPad devices), laptop or other mobile computers. Some of these devices may be configured to provide audio, video or other data or sensory output.

Figure 1A:
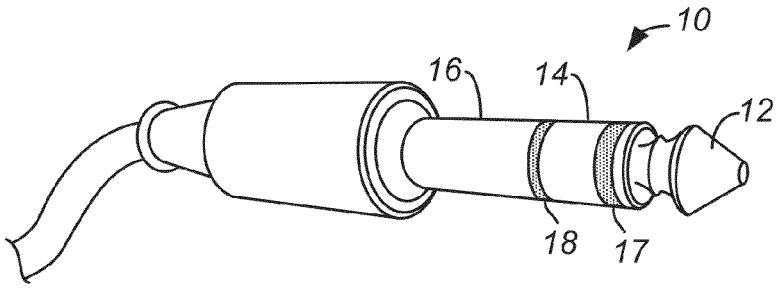
Fig. 1A Prior Art
FIGS. 1A and 1B show perspective views of previously known TRS audio plug connectors.
Figure 1B:
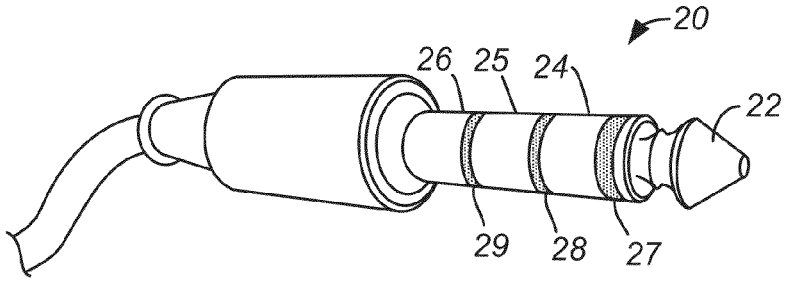
Fig. 1B Prior Art
Figure 2A:
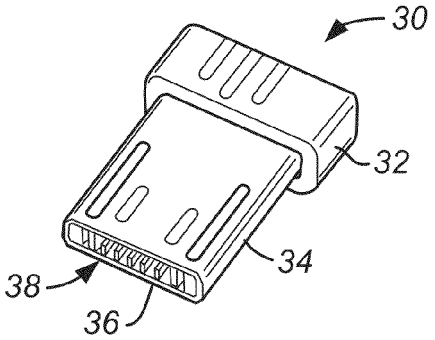
Fig. 2A Prior Art
Figure 2B:
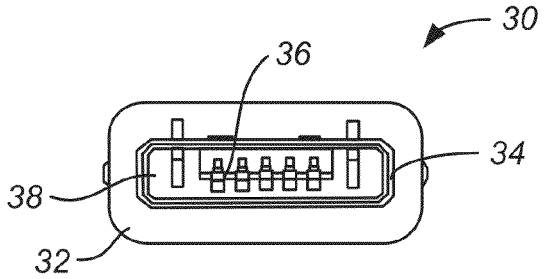
Fig. 2B Prior Art
FIG. 2B shows a front plan view of the micro-USB connector shown in FIG. 2A.
Figure 3:
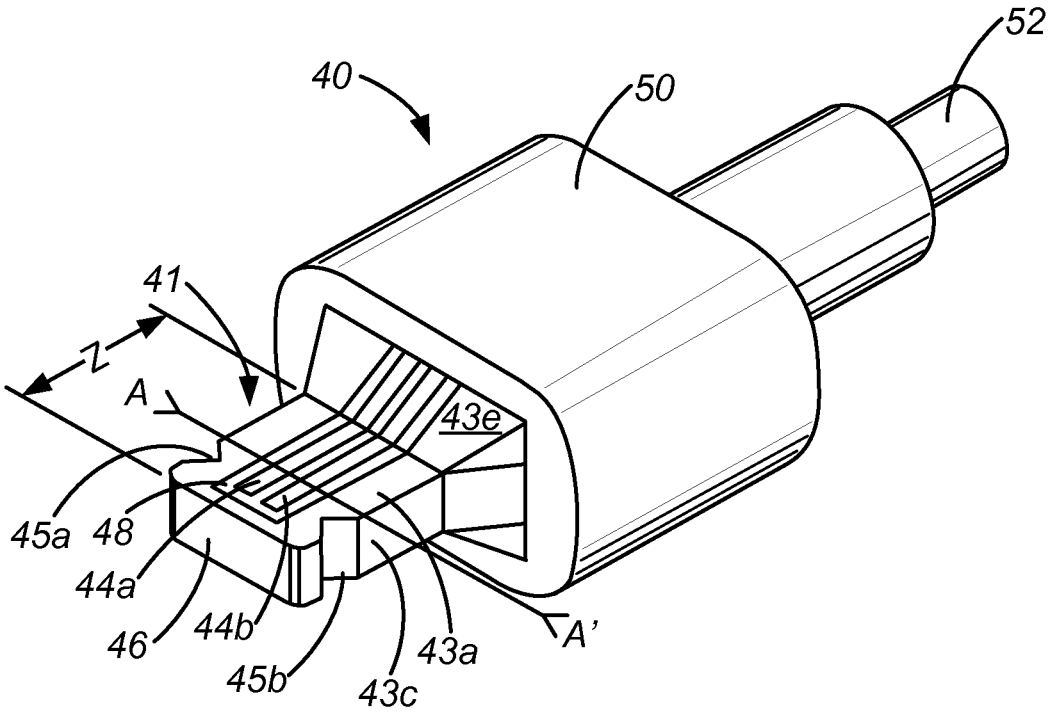
FIG. 3 is a simplified perspective view of an plug connector according to one embodiment of the present invention.

In order to better appreciate and understand the present invention, reference is first made to FIG. 3 which is a simplified perspective view of a first embodiment of an audio or data plug connector 40 according to the present invention. As shown in FIG. 3, connector 40 includes a substantially flat tab 41 that extends from a shell 50. Tab 41 includes a front major surface 43*a* upon which two contacts 44*a* and 44*b* are positioned and a back major surface 43*b* upon which two contacts 44*c* and 44*d* are located (43*b*, 44*c*, and 44*d* are not visible in FIG. 3). Two substantially thinner sides 43*c* and 43*d* (shown in FIG. 4B) extend between the front and back major surfaces.

In one particular embodiment, connector 40 is an audio plug connector and contact 44*a* is a left audio contact, contact 44*b* is a microphone contact, contact 44*c* (not visible in FIG. 3) is a right audio contact, and contact 44*d* (not visible in FIG. 3) is a second microphone contact. The contacts can be made from a copper, nickel, brass, a metal alloy or any other appropriate conductive material. Spacing is consistent between each pair of contacts 44*a*, 44*b* and 44*c*, 44*d* providing 180 degree symmetry so that plug connector 40 can be inserted into a corresponding receptacle connector in either of two orientations. For example, when connector 40 is mated with a corresponding receptacle jack, each of contacts 44*a*-44*d* is in electrical contact with a corresponding contact in the receptacle jack. Additionally, the two audio contacts 44*a* and 44*c* are located on opposite sides of the connector in a cater cornered arrangement (see FIG. 4B). Thus, microphone contact 44*d* is located directly opposite audio contact 44*a* and microphone contact 44*b* is located directly opposite audio contact 44*c*. In this manner, an audio contact is always on the right side of the connector and a microphone contact is always on the left side of the connector (as oriented from the connecter base to its distal end). A sensing circuit in the receptacle jack or the electronic device in which the receptacle jack is housed can detect the direction that the contacts 44*a*-44*d* are set and switch internal connections to the contacts in the connector jack as appropriate. For example, a software switch can be used to switch the receptacle jack's contacts for left and right audio depending on the insertion orientation while a hardware switch can be used to switch the connector jacks microphone and ground contacts to match the contacts of connector 40. In other embodiments, both switches can be implemented in software or both switches can be implemented in hardware. In another example, the orientation of the connector can instead be detected by circuitry associated with the corresponding receptacle connector based on signals received over the contacts. As one example, upon inserting a connector within a receptacle connector of a host device, the host device may send an Acknowledgment signal to the serial control chip over the contact in the receptacle connector designated for the specific contact and waits for a Response signal. If a Response signal is received, the contacts are aligned properly and audio and other signals can be transferred between the connectors. If no response is received, the host device flips the signals to correspond to the second possible orientation (i.e., flips the signals 180 degrees) and repeats the Acknowledgement/Response signal routine. In another embodiment, a physical orientation key (e.g., a unique notch or other physical features) formed on the plug connector, can be detected by an orientation contact or other appropriate mechanism in the receptacle connector to determine the orientation of the plug, and a hardware or software switch can set the receptacle connector contacts as appropriate for left and right audio or other data contacts to correspond to the plug connector contacts.

Two retention features, shown as V-shaped notches 45*a* and 45*b* in FIG. 3, are formed on opposing sides of tab 41 near its distal end. When tab 41 is inserted into a receptacle connector, notches 45*a* and 45*b* operatively engage with a retention mechanism, such as a cantilevered spring or detent, within the receptacle connector. In other embodiments, other retention mechanisms can be used such as mechanical or magnetic latches or orthogonal insertion mechanisms. Although retention features 45*a* and 45*b* shown in FIG. 3 are V-shaped notches, they may also be round notches (e.g., c-shaped or semi-circular notches), pockets, indentations, or similar recessed regions formed on each of the side surfaces 43*c*, 43*d* (43*d* is not visible in FIG. 3) that can operatively engage with a retention feature or mechanism in a corresponding receptacle connector. Connector 40 also includes a chamfered edge 43*e* surrounding tab 41 and extending from the front and back major surfaces 43*a*, 43*b* and thinner side surfaces 43*c*, 43*d* (not visible in FIG. 3) of the tab to base portion 42 (shown in FIG. 4A) of the connector that can be inserted within shell 50 (shown in FIG. 4A). Chamfered edge 43*e* stiffens and reinforces the connector near its base thus increasing its strength in a side-load condition.

As shown in FIG. 3, contacts 44*a*-44*d* are external contacts and connector 40 does not include an exposed cavity in which particles and debris may collect. To improve robustness and reliability, connector 40 is fully sealed and includes no moving parts. Furthermore, connector 40 has a considerably reduced insertion depth and insertion width as compared to commonly available TRS and TRRS connectors described above. In one particular embodiment, tab 41 of connector 40 has a width, X (shown in FIG. 4B), of 2 mm; a thickness, Y (shown in FIG. 4B), of 1 mm; and an insertion depth, Z, of 4 mm. In another embodiment, tab 41 of connector 40 has a width, X, of 4.1 mm; a thickness, Y, of 1.5 mm; and an insertion depth, Z, of 5.75 mm.

In other embodiments, connector 40 may include more than four contacts (with corresponding slots) total or more than four contacts (with corresponding slots) on each of surfaces 43*a* and 43*b*, e.g., 6, 8, 10, or more contacts and there may also be ground contacts at the distal tip of connector 40 or on side surfaces 43*c* and 43*d*. Where connector 40 is a data plug connector, many different types of digital signals can be carried by four or more contacts including data signals such as, USB signals (including USB 1.0, 2.0 and/or 3.0), FireWire (also referred to as Institute of Electrical and Electronics Engineers 1394 (IEEE 1394)) signals, Serial Advanced Technology Attachment (SATA) signals and/or any other type of data signal. Other digital signals that may be carried by the contacts of connector 40 include signals for digital video such as Digital Visual Interface (DVI) signals, High-Definition Multimedia Interface (HDMI) signals and Display Port signals, as well as other digital signals that perform functions that enable the detection and identification of devices, electronic media devices or accessories to connector 40.

Figure 4A:
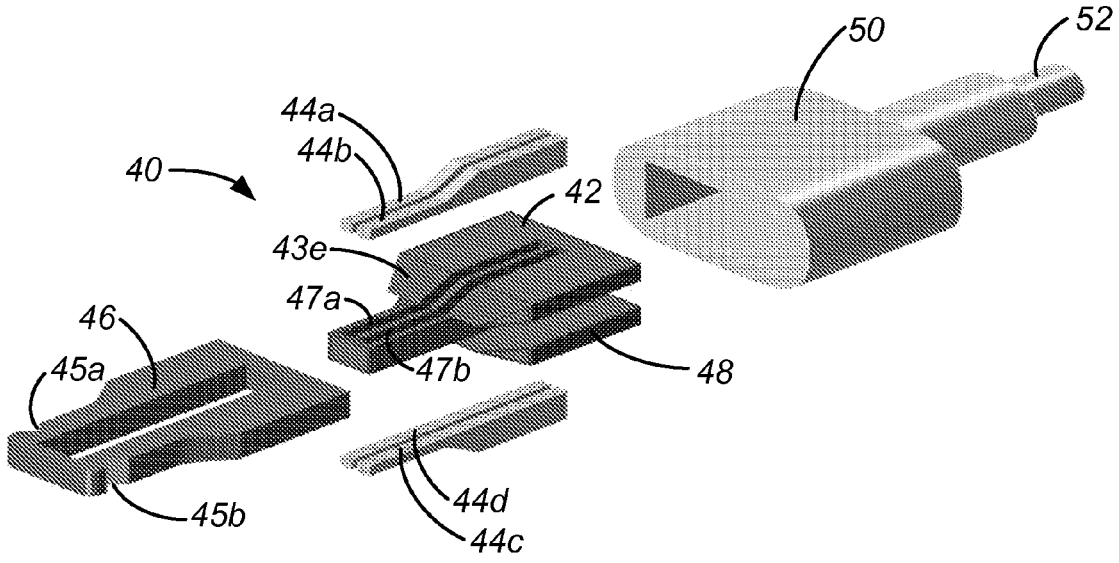
FIG. 4A is a simplified exploded perspective view of the connector 40 shown in FIG. 3.

FIG. 4A is a simplified exploded perspective view of connector 40 that better depicts how the various components of the connector are fabricated and joined together according to one particular embodiment of the invention. Connector 40 is formed around a metal plate 46 that can be stamped from high strength steel or formed in any other appropriate way. An insulation spacer 48 is molded around the metal plate 46 so that the combination of metal plate 46 and insulation spacer 48 define the basic shape of tab 41, base portion 42 and the chamfered edge 43*e* that extends between tab 41 and base portion 42. Two slots 47*a*, 47*b* are formed in an upper surface of insulation spacer 48 and two slots 47*c*, 47*d* (not visible in FIG. 4A) are formed in a lower surface of the spacer.

Contacts 44*a*-44*d* can be stamped from sheet metal formed in a sintering process from a metal powder or made according to other known techniques and inserted their respective slots, 47*a*-47*d*. Signal wires (not shown) are soldered to each of the contacts in an area within base 42 of the connector and a ground wire is soldered to metal plate 46 to provide a ground contact for connector 40. The wires extend through the connector to cord 52 that is coupled at its other end to an electronic device, such as a stereo headset. An acrylonitrile butadiene styrene (ABS) or similar shell 50 is positioned over and then fastened to base 42 of the connector to complete its formation.

Figure 4B:
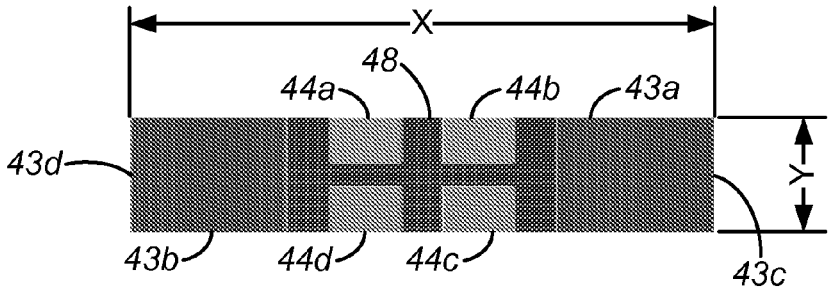
FIG. 4B is a simplified cross-sectional view of connector 40 shown in FIG. 3 taken across lines A-A' shown in FIG. 3.
Figure 5A:
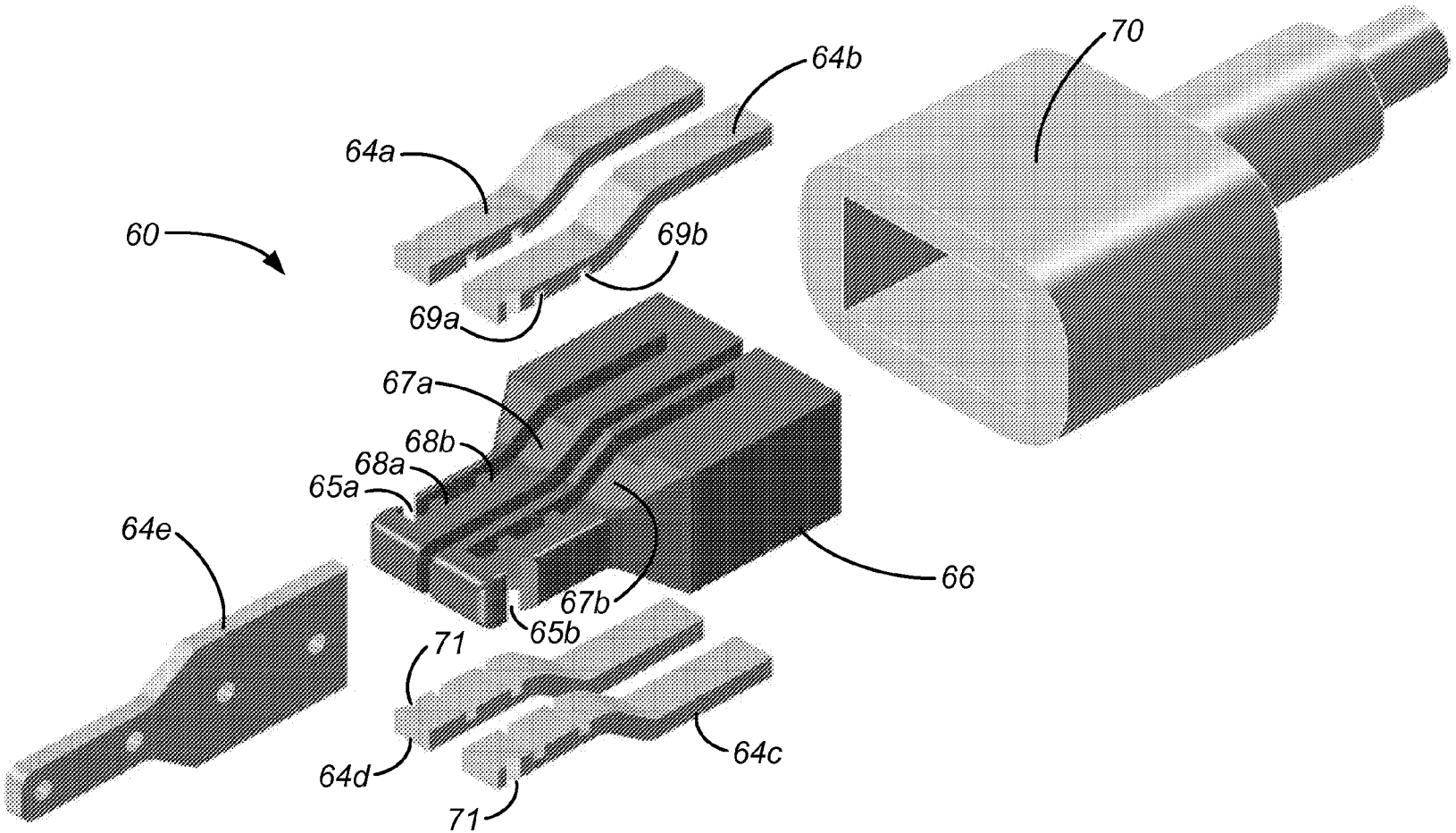
FIG. 5A is a simplified exploded perspective view of a plug connector 60 according to another embodiment of the present invention.
Figure 5B:
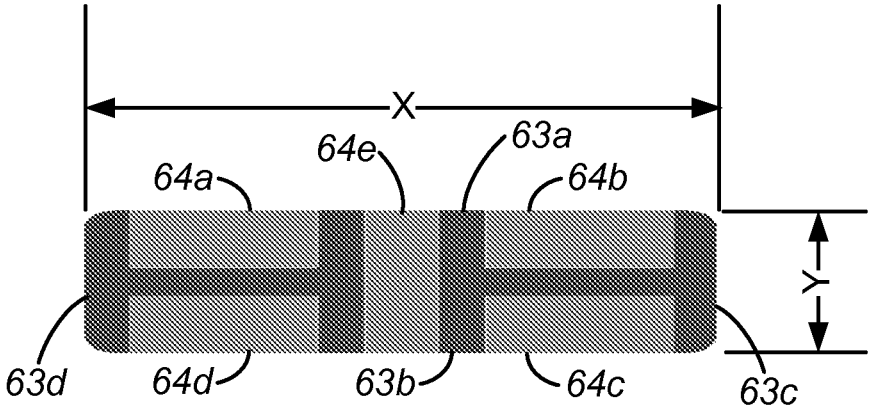
FIG. 5B is a simplified cross-sectional view of plug connector 60 shown in FIG. 5A taken along the same A-A' lines as the cross-section in FIG. 4B.

Reference is now made to FIGS. 5A and 5B in which FIG. 5A is a simplified exploded perspective view of a plug connector 60 according to another embodiment of the present invention and FIG. 5B is a simplified cross-sectional view of plug connector 60 shown in FIG. 5A taken along the same cross-section of the connector in FIG. 4B. Connector 60 includes four signal contacts 64*a*-64*d* farmed around a dielectric core 66 and a ground contact 64*e* that runs through the center of the connector. In one embodiment, contact 64*a* is a left audio contact, contact 64*b* is a microphone contact, contact 64*c* is a right audio contact and contact 64*d* is a second microphone contact. As shown in FIG. 5B, the contacts are arranged on a substantially flat tab portion of connector 60 to have a 180 degree symmetrical design similar to that of connector 40. A sensing circuit in the receptacle jack or the electronic device in which the receptacle jack is housed can detect the direction that contacts 64*a*-64*d* are set and switch internal connections to the contacts in the connector jack as appropriate.

Dielectric core 66 can be molded from a thermoplastic polymer or similar material around ground contact 64*e*. Slots 67*a*-67*d* (67*c* and 67*c* are not visible in FIG. 5A) are formed in core 66 for contacts 64*a*-64*d* which can be wire formed or stamped from sheet metal and bent. Slots 67*a*-67*d* include ribs 68*a*, 68*b* that align with grooves 69*a*, 69*b* formed in the corresponding contacts. Grooves 69*a*, 69*b* provide shear strength in bending for the contacts. Connector 60 is designed so that contacts 64*a*-64*d* provide much of the strength of the plug. Similar to connector 40, connector 60 also has a chamfered edge between its tab and base portions that may reinforce the connector near its base thus increasing its strength in a side-load condition. Additionally, retention features, shown as small V-shaped notches 71 in FIG. 5A, is formed in each of contacts 64*a*-64*d* that aligns with retention features, shown as V-shaped notches 65*a*, 65*b* in FIG. 5A, formed in dielectric core 66. In some embodiments, the shape of the retention features of connector 60 may be varied as discussed with reference to the retention features of connector 40. Once the contacts are adhered within their respective slots, core 66 can be slid within and bonded to an ABS or similar shell 70.

As with connector 40, contacts 64*a*-64*d* are external contacts and connector 60 does not include an exposed cavity in which particles and debris may collect. To improve robustness and reliability, connector 60 is also fully sealed and includes no moving parts. Furthermore, connector 60 has a considerably reduced insertion depth and insertion width as compared to commonly available TRS and TRRS connectors described above. In one particular embodiment, the insertion portion of connector 60 has a width, X, of 2 mm; a thickness, Y, of 1 mm; and an insertion depth, Z (as measured in FIG. 3), of 4 mm. In another embodiment, the insertion portion of connector 60 has a width, X, of 4.1 mm; a thickness, Y, of 1.5 mm; and an insertion depth, Z (as measured in FIG. 3), of 5.75 mm.

In some embodiments, as with connector 40, connector 60 may include more than four contacts (with corresponding slots) total or more than four contacts (with corresponding slots) on each of major surfaces 63*a* and 63*b* (shown if FIG. 5B), e.g., 6, 8, 10, or more contacts and there may also be ground contacts formed on side surfaces 63*c* and 63*d*. Where connector 60 is a data plug connector, many different types of digital signals can be carried by four or more contacts including data signals such as, USB signals (including USB 1.0, 2.0 and/or 3.0), FireWire (also referred to as IEEE 1394) signals, SATA signals and/or any other type of data signal. Other digital signals that may be carried by the contacts of connector 40 include signals for digital video such as DVI signals, HDMI signals and Display Port signals, as well as other digital signals that perform functions that enable the detection and identification of devices, electronic media devices or accessories to connector 40.

Figure 6A:
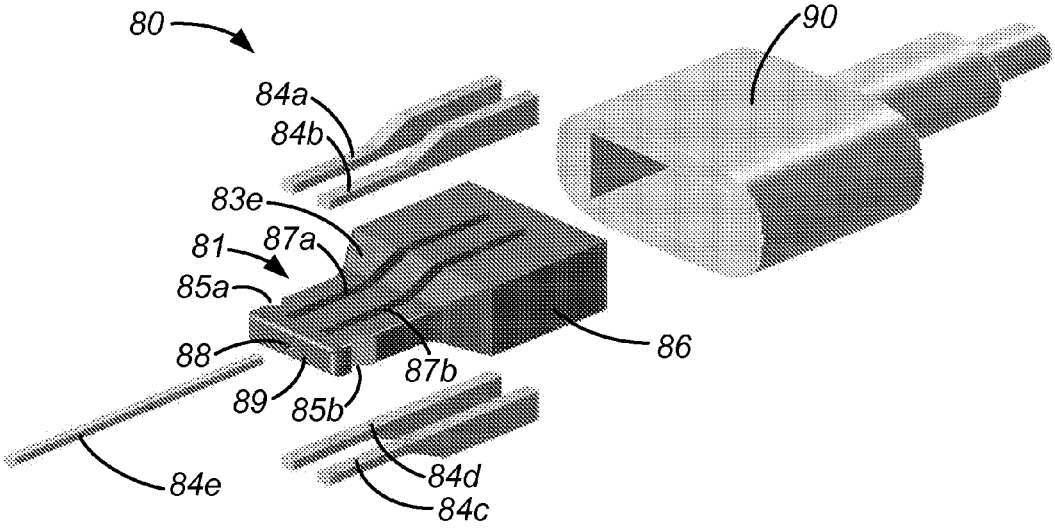
FIG. 6A is a simplified exploded perspective view of a plug connector 80 according to another embodiment of the present invention.
Figure 6B:
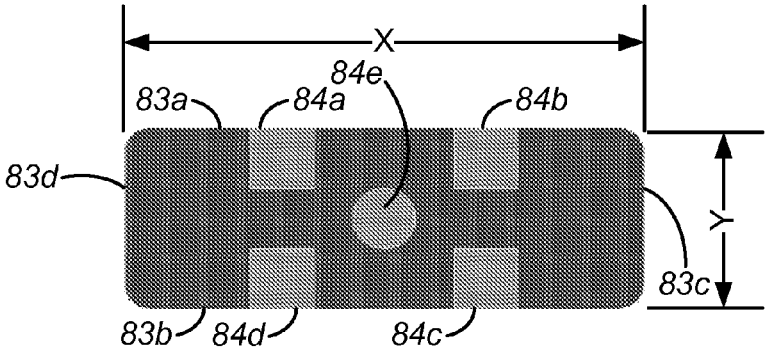
FIG. 6B is a simplified cross-sectional view of plug connector 80 shown in FIG. 6A taken along the same A-A' lines as the cross-section in FIG. 4B.

A connector 80 according to another embodiment of the present invention is shown in FIGS. 6A and 6B in which FIG. 6A is a simplified exploded perspective view of the plug connector 80 and FIG. 6B is a simplified cross-sectional view of connector 80 taken along the same cross-section of the connector as in FIGS. 4B and 5B. Connector 80 includes a substantially flat tab 81 that extends from a shell 90. Tab 81 includes a front major surface 83*a* upon which two contacts 84*a* and 84*b* are positioned and a back major surface 83*b* upon which two contacts 84*c* and 84*d* are located. Additionally, a fifth contact 84*e* extends through the center of connector 80 and is located at distal end 89 of the connector.

In one particular embodiment, contact 84*a* is a left audio contact, contact 84*b* is a microphone contact, contact 84*c* is a right audio contact, contact 84*d* is a second microphone contact, contact 84*e* is a ground contact and the contacts are positioned on connector 80 so that it has a 180 degree symmetrical design similar to that of connectors 40 and 60 so that plug connector 80 can be inserted into a corresponding receptacle connector in either of two orientations. The contacts can be made from a copper, nickel, brass, a metal alloy or any other appropriate conductive material. A sensing circuit in the receptacle jack or the electronic device in which the receptacle jack is housed can detect the direction that the contacts 84*a*-84*d* are set and switch internal connections to the contacts in the connector jack as appropriate.

Two retention features, shown as V-shaped notches 85*a* and 85*b* in FIG. 6A, are formed on opposing sides of tab 81 near distal end 89. When tab 81 is inserted into a receptacle connector, notches 85*a* and 85*b* operatively engage with a retention mechanism, such as a cantilevered spring or detent, within the receptacle connector. In other embodiments, other retention mechanisms can be used such as mechanical or magnetic latches or orthogonal insertion mechanisms. Connector 80 also includes a chamfered edge 83*e* surrounding tab 81 and extending from the upper and lower major surfaces 83*a*, 83*b* and the thinner side surfaces 83*c*, 83*d* of the tab to a base portion of the connector. Chamfered edge 83*e* stiffens and reinforces the connector near its base thus increasing its strength in a side-load condition.

As with connectors 40 and 60, the contacts 84*a*-84*d* of connector 80 are external contacts so the connector does not include an exposed cavity in which particles and debris may collect. Furthermore, connector 80 has a considerably reduced insertion depth and insertion width as compared to commonly available TRS and TRRS connectors described above. In one particular embodiment, tab 81 of connector 80 has a width, X, of 2 mm; a thickness, Y, of 1 mm; and an insertion depth, Z (as measured in FIG. 3), of 4 mm. In another embodiment, tab 81 of connector 80 has a width, X, of 4.1 mm; a thickness, Y, of 1.5 mm; and an insertion depth, Z (as measured in FIG. 3), of 5.75 mm.

As shown FIG. 6A connector 80 is formed around a ceramic core 86 that generally defines the shape of tab 81 and base portion 82 as well as the chamfered edge 83*e* that extends between tab 81 and the base portion. Two slots 87*a*, 87*b* are formed in an upper surface of ceramic core 86; two slots 87*c*, 87*d* (not visible in FIG. 6A) are formed in a lower surface of the core; and a hole 88 traverses through the core's center.

Ceramic core 86 can be formed by a ceramic injection molding (CIM) process or by a dry pressing, machining or other suitable processes. Ground contact 84*e* can be made from a metal wire or cut from sheet metal and inserted through hole 88 so that the end of the ground contact is flush with the outer edge of ceramic core 86 at distal end 89 of the connector. Contacts 84*a*-84*d* can be made from sheet metal and inserted into respective ones of slots 87*a*-87*d*, and in another embodiment the contacts can be formed in a sintering process from a metal powder.

In some embodiments, contacts 84*a*-84*d* can be used to carry any appropriate data signal (e.g., the data signals mentioned with reference to connector 40) as well as audio signals, video signals and the like. In some embodiments, there may be more than four contacts on connector 80 with corresponding slots, e.g., 6, 8, 10, or more contacts, and there may also be ground contacts in the retention features or otherwise formed on sides 83*c* and 83*d*, as discussed with reference to previous embodiments.

Figure 7A:
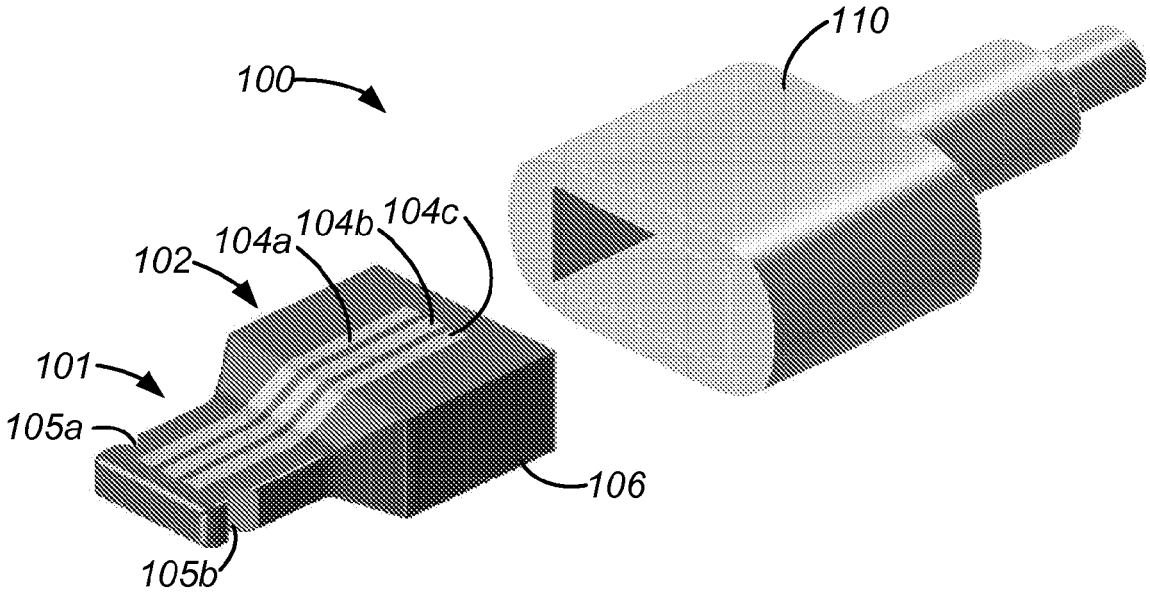
FIG. 7A is a simplified exploded perspective view of a plug connector 100 according to another embodiment of the present invention.
Figure 7B:
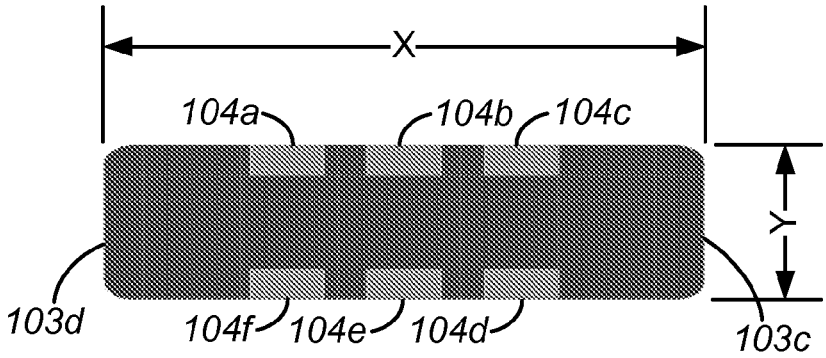
FIG. 7B is a simplified cross-sectional view of plug connector 100 shown in FIG. 7A taken along the same A-A' lines as the cross-section in FIG. 4B.

Another embodiment of the present invention is shown in FIGS. 7A and 7B where FIG. 7A is a simplified exploded perspective view of a plug connector 100 and FIG. 7B is a simplified cross-sectional view of connector 100 taken along the same cross-section of the connector as in FIGS. 4B, 5B and 6B. Connector 100 has six contacts 104*a*-104*f* attached to a ceramic core 106 that defines a substantially flat connector tab 101 and a base portion 102. In one embodiment, contacts 104*a*-104*f*, represent a left audio contact (104*a*), a ground contact (104*b*), a microphone contact (104*c*), a right audio contact (104*d*), a second ground contact (104*e*) and a second microphone contact (1040. Similar to connectors 40, 60 and 80, connector 100 has 180 degree symmetry (as shown in FIG. 7B) so that it can be inserted in a jack connector in either of two orientations. A sensing circuit in the receptacle jack or the electronic device in which the receptacle jack is housed can detect the direction that the contacts 104*a*-104*d* are set and switch internal connections to the contacts in the connector jack as appropriate. Additionally, notches 105*a*, 105*b* provide a retention feature similar to notches 45*a*, 45*b*. Similar to connector 40, 60 and 80, connector 100 also has a chamfered edge between tab 101 and base portion 102 that may reinforce the connector near its base thus increasing its strength in a side-load condition.

Ceramic core 106 can be formed from a ceramic injection molding process among other techniques and in one particular embodiment is formed in a double shot process in which core 106 is formed in a first injection molding step that forms six slots in which contacts 104*a*-104*f* are subsequently formed with a metal injection molding process. In another embodiment contacts 104*a*-104*f* are formed using powdered metallurgy (PM) techniques. After the contacts are formed on core 106, it is bonded within an ABS or similar shell 110 at a base portion 102 of the core.

As with connectors 40, 60 and 80, the contacts 104*a*-104*d* of connector 100 are external contacts so the connector does not include an exposed cavity in which particles and debris may collect. Furthermore, connector 100 has a considerably reduced insertion depth and insertion width as compared to commonly available TRS and TRRS connectors described above. In one particular embodiment, tab 101 of connector 100 has a width, X, of 2 mm; a thickness, Y, of 1 mm; and an insertion depth, Z (as measured in FIG. 3), of 4 mm. In another embodiment, tab 101 of connector 100 has a width, X, of 4.1 mm; a thickness, Y, of 1.5 mm; and an insertion depth, Z (as measured in FIG. 3), of 5.75 mm.

In some embodiments, contacts 104*a*-104*f* can be used to carry any appropriate data signal (e.g., the data signals mentioned with reference to connector 40) as well as audio signals, video signals and the like. In some embodiments, there may be more than six or less than six contacts on connector 100 with corresponding slots, e.g., 4, 8, 10, or more contacts, and there may also be ground contacts in the retention features or otherwise formed on sides 103*c* and 103*d*, as discussed with reference to previous embodiments.

Figure 8A:
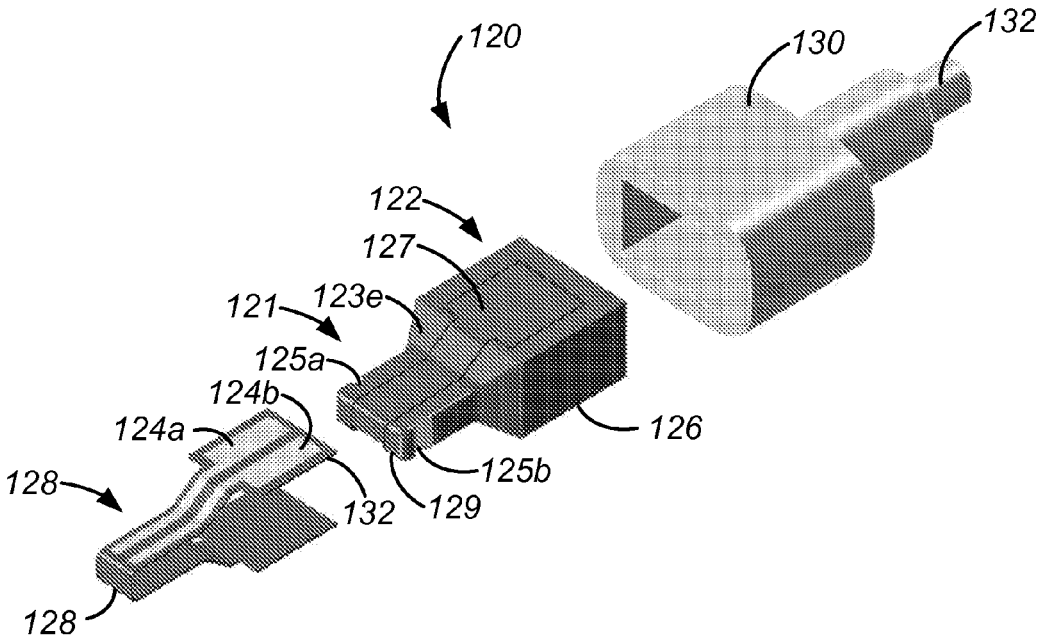
FIG. 8A is a simplified exploded perspective views of a plug connector 120 according to another embodiment of the present invention.
Figure 8B:
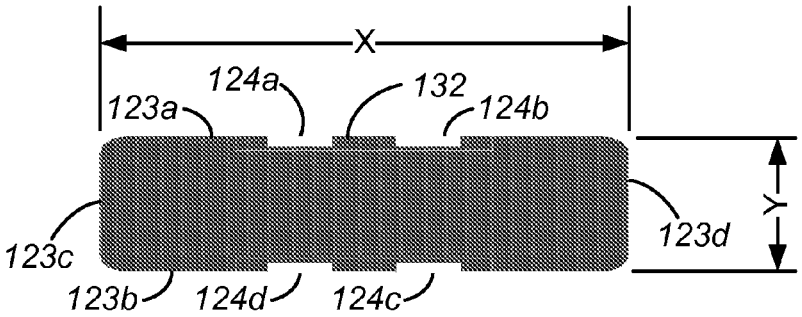
FIG. 8B is a simplified cross-sectional view of plug connector 120 shown in FIG. 8A taken along the same A-A' lines as the cross-section in FIG. 4B.

FIG. 8A is a simplified exploded perspective views of a plug connector 120 according to yet another embodiment of the present invention and FIG. 8B is a simplified cross-sectional view of plug connector 120 shown in FIG. 8A taken along the same A-A' lines as the cross-section in FIG. 4B. Connector 120 includes a conductive core 126 that can be formed from a metal injection molding (MIM) process or another appropriate technique. Core 126 includes a connector tab portion 121 and a base portion 122 and acts as a carrier base for contacts 124*a*-124*d*.

Connector tab 121 includes upper and lower major sides 123*a* and 123*b* as well as substantially thinner sides 123*c* and 123*d* that extend between the upper and lower major sides. A chamfered edge 123*e* connects tab portion 121 to base portion 122 that stiffens and reinforces the connector near its base thus increasing its strength in a side-load condition.

Retention features, shown as notches 125*a*, 125*b* in FIG. 8A, can be formed on side surfaces 123*c*, 123*d* near a distal end of the connector and operatively engage with a retention mechanism within corresponding connector jack. Although retention features 125*a*, 125*b* in FIG. 8A are shown as notches, they may also be v-shaped notches, pockets, indentations, or similar recessed regions that can operatively engage with a retention feature or mechanism in a corresponding receptacle connector. On its outer surface, conductive core 126 further includes a recessed region 127 that images extends along the first major surface 123*a* at base portion 122 of core 126 down the center of the core along chamfered edge 123*e* and tab 121 and wraps around the tip 129 and, on surface 123*b* mirrors its shape on surface 123*a*. A flex circuit 128 can be slipped over the end of the connector and adhered into recessed region 127. Flex circuit may include, for example, thick copper traces that act as contacts 124*a*-124*d* coated with nickel and palladium formed on a thin polymide or PEEK (polyether ether ketone) layer. In another embodiment, the recessed region 127 does not extend around tip 129 of connector 120 and instead comprises two separate recessed regions on each of the major surfaces. In this embodiment, flex circuit 128 can be made from two separate pieces each of which is directly adhered to one of the upper and lower major sides 123*a*, 123*b* within its respective recessed region. Similar to connectors 40, 60, 80 and 100, connector 120 has 180 degree symmetry so that it can be inserted in a jack connector in either of two orientations. A sensing circuit in the receptacle jack or the electronic device in which the receptacle jack is housed can detect the direction that the contacts 124*a*-124*d* are set and switch internal connections to the contacts in the connector jack as appropriate. Signal wires (not shown) are soldered to each of the contacts in an area within base 122 of the connector and a ground wire is soldered to conductive core 126 to provide a ground contact for connector 120. The wires extend through the connector to cord 132 that is coupled at its other end to an electronic device, such as a stereo headset. An ABS or similar shell 130 is positioned over and then fastened to base 130 of the connector to complete its formation.

As with connectors 40, 60, 80 and 100, the contacts 124*a*-124*d* of flex circuit 128 of connector 120 are external contacts so the connector does not include an exposed cavity in which particles and debris may collect. Furthermore, connector 120 has a considerably reduced insertion depth and insertion width as compared to commonly available TRS and TRRS connectors described above. In one particular embodiment, tab 121 of connector 120 has a width, X, of 2 mm; a thickness, Y, of 1 mm; and an insertion depth, Z (as measured in FIG. 3), of 4 mm. In another embodiment, tab 121 of connector 120 has a width, X, of 4.1 mm; a thickness, Y, of 1.5 mm; and an insertion depth, Z (as measured in FIG. 3), of 5.75 mm.

In some embodiments, contacts 124*a*-124*d* can be used to carry any appropriate data signal (e.g., the data signals mentioned with reference to connector 40) as well as audio signals, video signals and the like. In some embodiments, there may be more than 4 contacts on connector 100 with corresponding slots, e.g., 6, 8, 10, or more contacts, and there may also be ground contacts in the retention features or otherwise formed on sides 123*c* and 123*d*, as discussed with reference to previous embodiments.

When inserted into a matching connector jack, connectors according to some embodiments of the present invention are designed to break when side-loaded at a certain tension. It is preferable that the plug connector breaks as opposed to the connector jack because if the jack breaks, the electronic device in which it is housed may no longer be usable.

As will be understood by those skilled in the art, the present invention may be embodied in other specific foams without departing from the essential characteristics thereof. For example, while embodiments of the invention were discussed above with respect to audio plugs having four to six contacts, the invention is not limited to any particular number of contacts. Some embodiments of the invention may have as few as two contacts while other embodiments can have thirty or even more contacts. In many of these embodiments, the contacts can be arranged to have 180 degree symmetry so that the connector can be inserted into a receptacle connector in either of two different orientations.

Additionally, while the invention was described with respect to an audio connector in some cases, it is not limited to any particular type of signal and can be used to carry video and/or other signals instead of audio-related signals or in addition to audio-related signals. Also, in some embodiments, connectors according to the present invention can carry both analog and digital signals. As an example, connectors according to the present invention can be modified to include one or more fiber optic cables that extend through the connector and can be operatively coupled to receive or transmit optical signals between a mating connector jack. Fiber optic cables allow for high data rate transmissions and can be used for USB 4.0 compatibility (e.g. 10 gigabytes/second data transfer). Connectors according to the present invention may include power, audio and data connections and can be used to charge a device while simultaneously providing data and audio functions. Those skilled in the art will recognize, or be able to ascertain using no more than routine experimentation, many equivalents to the specific embodiments of the invention described herein. Such equivalents are intended to be encompassed by the following claims.

What is claimed is:

1. A plug connector comprising:

a metal plate having a substantially flat tip portion at its distal end with first and second opposing major sides and a central opening formed through the metal plate;

a dielectric spacer having a substantially flat tip portion formed within the opening in the metal plate and a base portion that is thicker than the tip portion formed at a proximal end of the metal plate, wherein the dielectric spacer has first and second opposing outer surfaces that extend from the tip portion to the base portion and a plurality of slots formed at each of the first and second outer surfaces; and a plurality of contacts positioned within the plurality of slots in the dielectric spacer.

2. The plug connector set forth in claim 1 wherein the plug connector is shaped to have 180 degree symmetry so that the plug connector can be inserted and operatively coupled to a corresponding receptacle connector in either of two orientations.

3. The plug connector set forth in claim 1 wherein the first and second outer surfaces of the dielectric spacer are substantially flush with the first and second major sides of the metal plate.

4. The plug connector of claim 1 further comprising a shell coupled to the base portion of the dielectric spacer.

5. The plug connector of claim 4 further comprising a plurality of wires corresponding to the plurality of contacts, wherein each of the wires is connected to its respective contact at a connection point on a proximate end of the base portion of the dielectric spacer.

6. The plug connector of claim 1 wherein the plurality of contacts are stamped from sheet metal and inserted within the plurality of slots.

7. The plug connector of claim 2 wherein the plurality of slots and the plurality of contacts are symmetrically spaced so that the plug connector has 180 degree symmetry and can be inserted and operatively coupled to a corresponding receptacle connector in either of two positions.

8. The plug connector of claim 1 wherein the plurality of slots comprise four slots formed at each of the first and second outer surfaces and the plurality of contacts comprise four contacts positioned within the four slots formed at each of the first and second outer surfaces.

9. The plug connector of claim 1 wherein the plurality of slots are formed to extend from the tip portion of the dielectric spacer to the base portion of the dielectric spacer.

10. The plug connector of claim 1 wherein the dielectric spacer is molded around the metal plate.

11. The plug connector of claim 1 further comprising:

the metal plate further comprising third and fourth opposing sides, each extending between the first and second major opposing sides of the metal plate, wherein the third and fourth opposing sides are significantly narrower than the first and second sides; and the dielectric spacer further comprising third and fourth opposing outer surfaces, each extending between the first and second opposing outer surfaces of the dialectic spacer, wherein the third and fourth opposing outer surfaces are significantly narrower than the first and second opposing outer surfaces.

12. The plug connector of claim 11 wherein the metal plate further comprises retention features formed near its distal end on each of the third and fourth surfaces that are adapted to engage with a retention mechanism in a corresponding receptacle jack.

13. The plug connector of claim 12 wherein the retention features are V-shaped notches formed in the metal plate.

14. The plug connector of claim 4 wherein the dielectric spacer has a chamfered portion at its base so that the plug connector increases in diameter to match an outer profile of the shell.

15. The plug connector of claim 1 wherein connector comprises left and right audio contacts arranged cater cornered on opposing sides of the connector and the connector has 180 degree symmetry so that it can be inserted into a corresponding connector jack in either of two positions.

16. The plug connector of claim 15 wherein the metal plate acts as a ground contact.

17. The plug connector of claim 11 wherein the metal plate comprises ground contacts formed on the third and fourth opposing sides.

18. A plug connector comprising:

a dielectric core having first and second opposing major surfaces and a plurality of grooves formed within each of the first and second major surfaces, the grooves symmetrically formed on left and right halves of the dielectric core; and a plurality of contacts positioned within the plurality of grooves in the dielectric core;

wherein the plug connector has a substantially flat tip portion at its distal end on which at least a portion of the plurality of contacts are carried;

wherein the plug connector has 180 degree symmetry so that it can be inserted into a corresponding connector jack in either of two positions.

19. The plug connector of claim 18 wherein the plurality of contacts comprise left and right audio contacts arranged cater cornered on opposing sides of the connector.

20. The plug connector of claim 18 wherein the dielectric core comprises a ceramic material.

21. The plug connector of claim 20 wherein the dielectric core further comprises a slot formed between the first and second major surfaces, the slot centrally located in the dielectric core such that it divides the core into left and right halves that mirror each other, and wherein the plug connector further comprises a centrally located ground contact positioned within the slot.

22. The plug connector of claim 21 wherein the ground contact is flush with the dielectric core at its distal end and at the first and second opposing major sides of flat tip portion of the dielectric core.

23. The plug connector of claim 19 further comprising a base portion formed at a proximal end of the dielectric core and a shell coupled to the base portion wherein the dielectric spacer has a chamfered portion between the substantially flat tip portion and its base so that the plug connector increases in diameter to match an outer profile of the shell.

24. The plug connector of claim 19 wherein the dielectric core further comprises a centrally located hole that extends from a distal end of the tip portion through the length of the dielectric core, and wherein the plug connector further comprises a ground contact positioned within the hole.

25. The plug connector of claim 24 wherein the dielectric core comprises a ceramic material.

26. A plug connector comprising:

a conductive core having a substantially flat tip portion and first and second opposing major surfaces;

wherein a recessed area is formed on the first and second opposing major surfaces, and a plurality of contacts positioned on the first and second opposing surfaces in a 180 degree symmetric relationship so the plug connector can be inserted into a corresponding receptacle connector in either of two positions;

wherein the plurality of contacts are formed on a flex circuit that is adhered to the conductive core in the recessed area.

27. The plug connector of claim 26 wherein the recessed area comprises two separate recessed regions on each of the major surfaces.

28. The plug connector of claim 26 wherein the flex circuit comprises thick copper traces coated with nickel and palladium formed on a thin polymide layer that act as the plurality of contacts.

29. The plug connector of claim 26 further comprising a base portion formed at a proximal end of the conductive core and a shell coupled to the base portion of the conductive core.

* * * * *